US006918454B2

(12) United States Patent
Prior et al.

(10) Patent No.: US 6,918,454 B2
(45) Date of Patent: Jul. 19, 2005

(54) AUTOMATED CONTROL SYSTEM FOR BACK-REAMING

(75) Inventors: Bruce Prior, Yorba Linda, CA (US); Mike Porche, Round Rock, TX (US)

(73) Assignee: Varco I/P, Inc., Orange, CA (US)

( * ) Notice: Subject to any disclaimer, the term of this patent is extended or adjusted under 35 U.S.C. 154(b) by 0 days.

(21) Appl. No.: 10/781,398

(22) Filed: Feb. 17, 2004

(65) Prior Publication Data

US 2004/0226748 A1 Nov. 18, 2004

Related U.S. Application Data

(60) Provisional application No. 60/447,984, filed on Feb. 15, 2003.

(51) Int. Cl.[7] ..... E21B 44/04
(52) U.S. Cl. ..... 175/26; 175/40
(58) Field of Search ..... 175/26, 40, 27, 175/45, 61, 121, 113

(56) References Cited

U.S. PATENT DOCUMENTS 4,809,792 A * 3/1989 Lynch ..... 175/113
5,107,940 A * 4/1992 Berry ..... 175/85
6,289,997 B1 * 9/2001 Bischel et al. ..... 175/24
6,719,069 B2 * 4/2004 Alft et al. ..... 175/24
6,766,869 B2 * 7/2004 Brand et al. ..... 175/24

* cited by examiner

*Primary Examiner*—Frank Tsay
(74) *Attorney, Agent, or Firm*—Christie, Parker & Hale, LLP

(57) ABSTRACT

A system that controls a back reaming operation of a drilling rig is provided that includes a hoisting system that moves a drill pipe during a back reaming operation at a hoisting speed and a hoisting torque. The hoisting system comprises at least one back reaming parameter sensor for measuring a corresponding at least one back reaming parameter. An operator control unit allows an operator to input a predetermined value of the at least one back reaming parameter therein. A back reaming parameter sensor obtains the measured value of the at least one back reaming parameter. A control system monitors the at least one back reaming parameter. A braking assembly resists the hoisting torque of the drawworks system when the measured value of the at least one back reaming parameter equals the predetermined value of the at least one back reaming parameter.

13 Claims, 3 Drawing Sheets

AUTOMATED CONTROL SYSTEM FOR BACK-REAMING

CROSS-REFERENCE TO RELATED APPLICATION(S)

This application claims priority under 35 U.S.C. §119(e) to U.S. Provisional Application Ser. No. 60/447,984, filed on Feb. 15, 2003, which is incorporated herein by reference.

FIELD OF THE INVENTION

The present invention relates to an automated control system for operating a drawworks or similar hoisting means during a back reaming operation.

BACKGROUND OF THE INVENTION

In the petroleum industry, the apparatus and machinery used to drill wells is commonly known as a drilling rig or a rig. On these rigs are means of rotating the drill pipe, the most popular and successful of which is a device known as a top drive system. The popularity and proliferation of top drive systems within the oilfield has greatly enhanced the capability of the industry's drillers and operators to handle drill pipe operations in safe and beneficial manners.

One such operation is "back reaming" wherein the operator hoists a drill pipe out of a borehole while simultaneous pumping drilling mud and rotating the drill pipe, thus avoiding the build-up of frictional forces between the drill pipe and the borehole that may lead to the drill pipe being jammed in the borehole. Until recently this back-reaming process has been done either completely manually or has involved the use of complicated controls within the hoisting equipment.

For example, in the manual process, the operator engages a hoisting means by engaging a clutch and then manually manipulating a hoisting throttle, either a hand or foot throttle, to slowly and carefully hoist the drill pipe out of the borehole. However, during this operation, the driller must simultaneously monitor the hookload, and the rotating torque or standpipe pressure (if using a downhole mud motor) for indications that the pipe is in danger of jamming in a lateral direction or a rotational direction, respectively.

Alternatively, in another process, the operator may be required to operate a control system that is connected to the hoisting means. In such a system, upon a command from the operator, the control system activates the hoisting means to slowly hoist the pipe out of the borehole. However, the driller must still monitor the hookload, the rotating torque and/or the standpipe pressure for indications of that the drill pipe may be in danger of jamming in the borehole.

In addition, a problem with both of these processes is that many hoisting systems cannot tolerate holding a drill pipe without movement for an extended period of time, a situation that can occur when a drill pipe does jam in the borehole. Thus, each of these processes relies on the operator's judgment to avoid equipment damage. Accordingly, a need exists for an improved control system that allows for greater control of the back reaming process while reducing operator burden.

SUMMARY OF THE INVENTION

The present invention is directed to a control system for the automated operation of a drawworks during a "back reaming" operation. In one embodiment the control system is connected to an operator control unit to allow a driller to enter maximum values to be reached during the reaming operation for one or more specified reaming parameters. During the reaming operation, the control system continuously monitors the specified reaming parameters and compares the measured values to the limits or maximum values input by the operator. When any of the maximum values are exceeded, a control signal is sent to the drawworks to reduce the speed of the hoisting.

In another embodiment, the specified reaming parameters may be selected from any or all of the pull on the drill bit (POB), the rate of hoisting (ROH), and the drilling torque. In still another embodiment, the speed of hoisting is controlled by the application of a drawworks brake assembly.

In one embodiment, the present invention is an automated method for controlling a back reaming operation of a drilling rig. The method includes providing a hoisting system that moves a drill pipe during a back reaming operation at a hoisting speed and a hoisting torque. The hoisting system includes at least one back reaming parameter sensor for measuring a corresponding at least one back reaming parameter. The method further includes comparing a predetermined value of the at least one back reaming parameter with the measured value for the at least one back reaming parameter; and initiating a braking assembly that resists the hoisting torque of the hoisting system when the measured value of the at least one back reaming parameter equals the predetermined value of the at least one back reaming parameter.

In another embodiment, the present invention is an automated method for controlling a back reaming operation of a drilling rig. The method includes providing a drawworks system that moves a drill pipe during a back reaming operation at a hoisting speed and a hoisting torque. The hoisting system comprises at least one back reaming parameter sensor for measuring a corresponding at least one back reaming parameter. The method further includes providing an operator control unit that allows an operator to input a predetermined value of the at least one back reaming parameter therein; and providing a control system that compares the predetermined value of the at least one back reaming parameter with the measured value for the at least one back reaming parameter, wherein the control system initiates a braking assembly that resists the hoisting torque of the drawworks system when the measured value of the at least one back reaming parameter equals the predetermined value of the at least one back reaming parameter.

In yet another embodiment, the present invention is a system that controls a back reaming operation of a drilling rig that includes a hoisting system that moves a drill pipe during a back reaming operation at a hoisting speed and a hoisting torque. The hoisting system comprises at least one back reaming parameter sensor for measuring a corresponding at least one back reaming parameter. An operator control unit allows an operator to input a predetermined value of the at least one back reaming parameter therein. A back reaming parameter sensor obtains the measured value of the at least one back reaming parameter. A control system monitors the at least one back reaming parameter. A braking assembly resists the hoisting torque of the drawworks system when the measured value of the at least one back reaming parameter equals the predetermined value of the at least one back reaming parameter.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
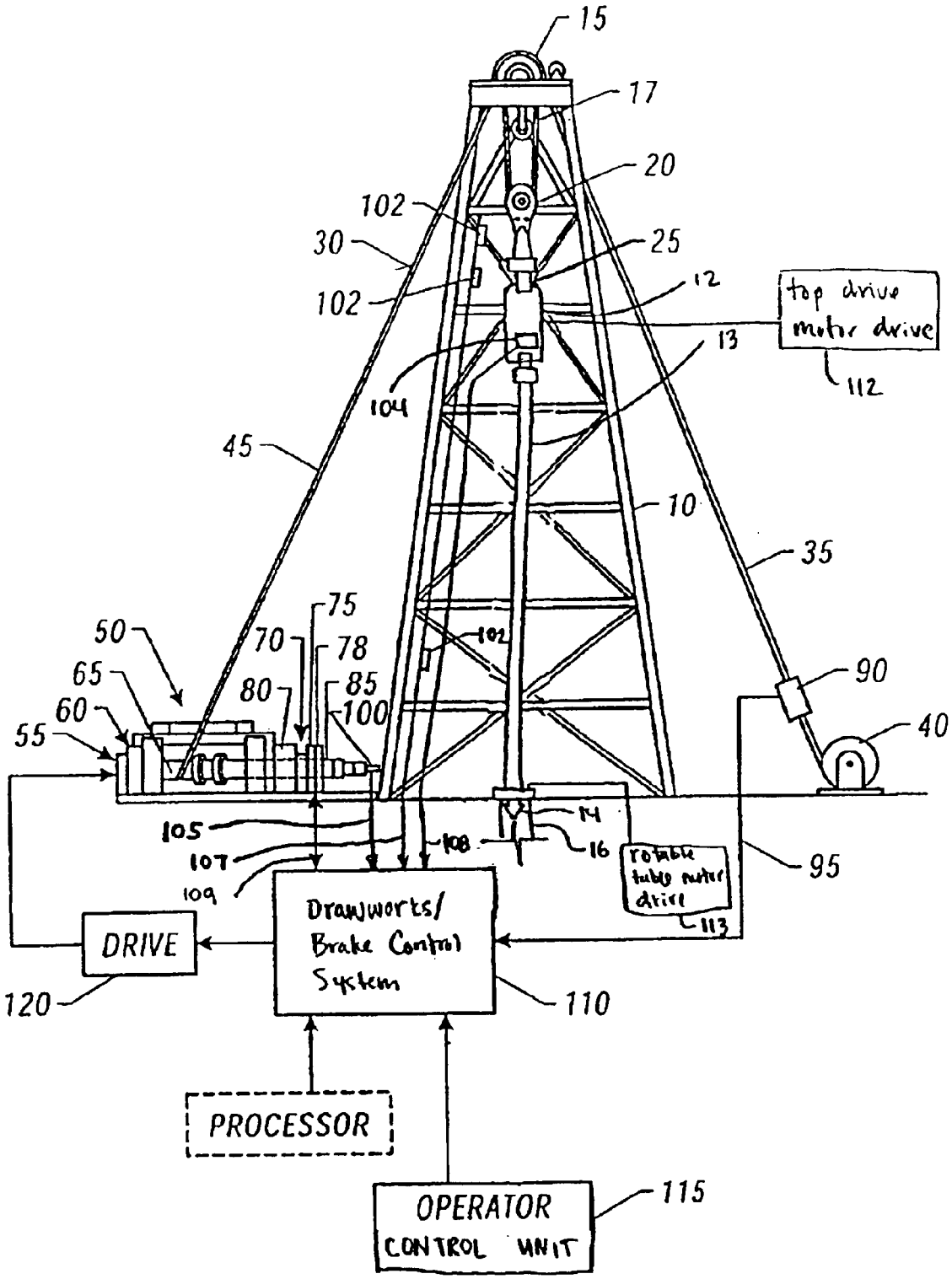
FIG. 1 is a schematic representation of a drilling rig and a drawworks/brake control system according to the present invention.
Figure 2:
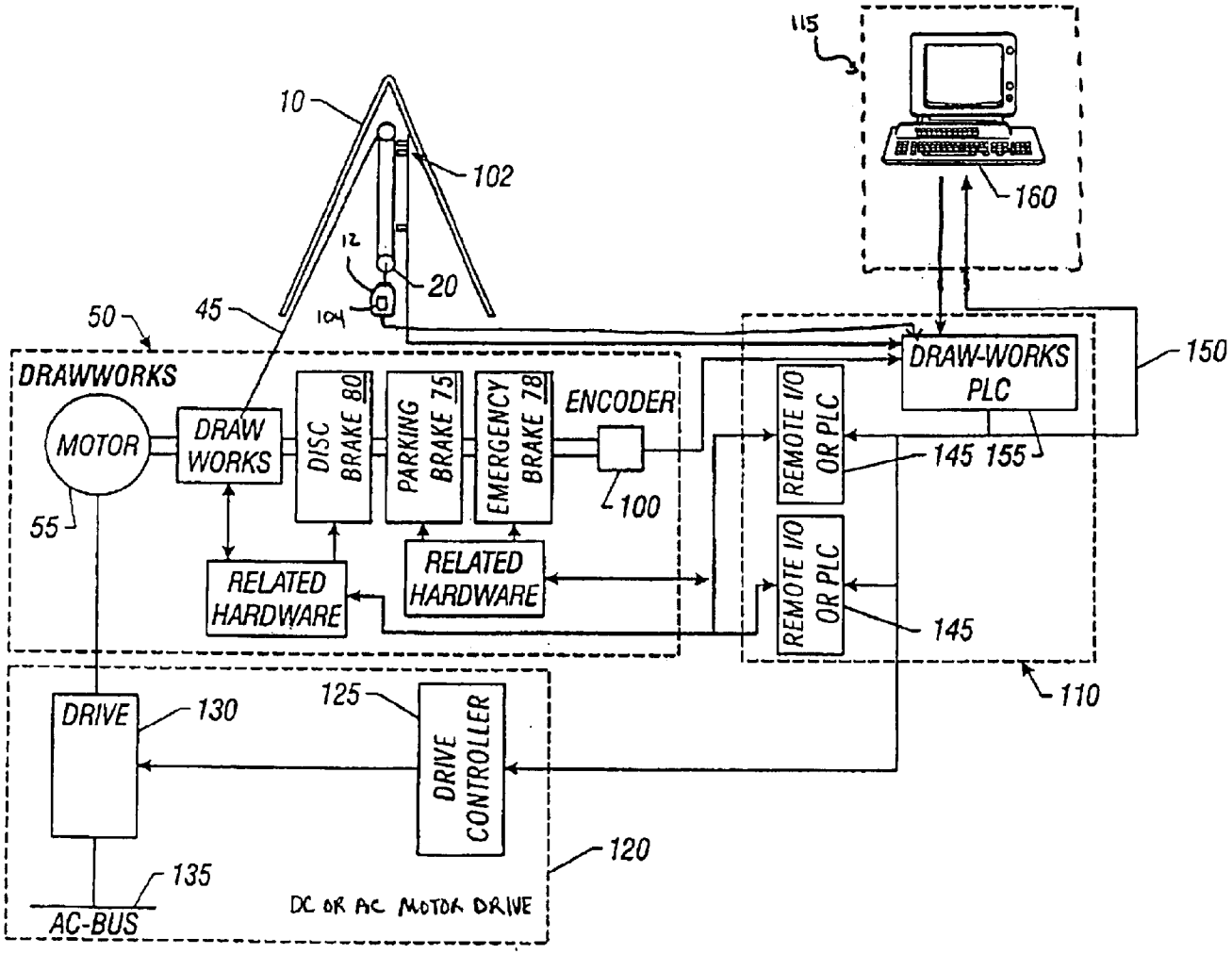
FIG. 2 is a block diagram of the drawworks/brake control system of FIG. 1 including a signal flow diagram.
Figure 3:
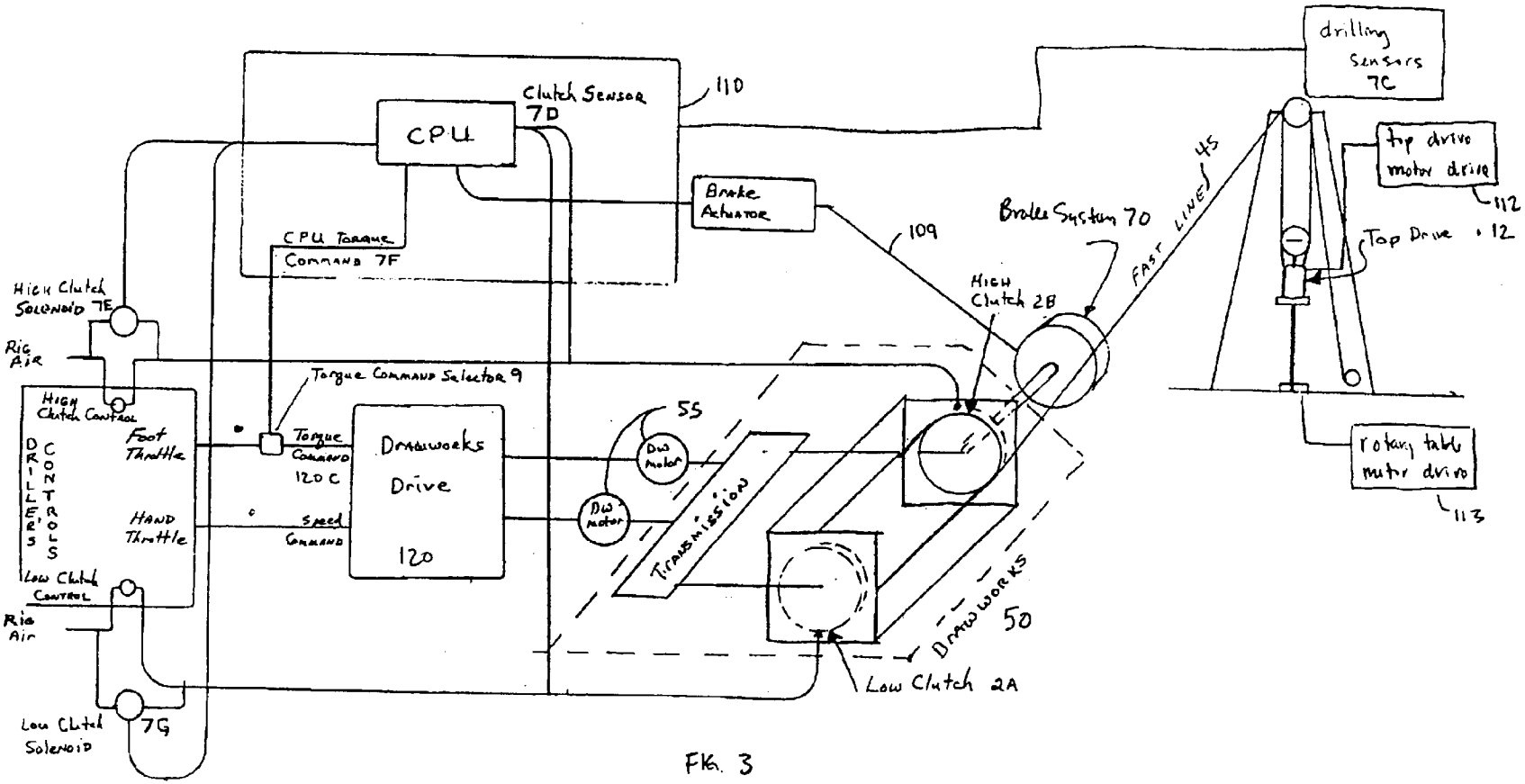
FIG. 3 is a schematic representation of the drawworks/brake control system of FIG. 1.

As shown in FIGS. 1–3, the invention is directed to a drawworks/brake control system 110 (hereinafter "control system 110") for the automated operation of a drawworks 50 or similar hoisting means during a "back reaming" (hereinafter "reaming") operation.

As shown in FIG. 1, in one embodiment of the current invention the control system 110 is connected to an operator control unit 115. A driller or operator enters into the control unit 115 maximum values to be reached during the reaming operation for one or more specified reaming parameters. For example, the reaming parameters may include any or all of the pull on the drill bit (POB), the rate of hoisting (ROH), and the drilling torque. The operator then initiates the reaming operation.

During the reaming operation, the control system 110 continuously monitors the POB, ROH and/or the drilling torque through various sensors 90, 100 and 104, and compares the measured values to the limits or maximum values input by the operator. When any of the maximum values are exceeded, a brake assembly 70 is activated via a control signal 109 from the control system 110 to reduce the speed of the hoisting. In such an embodiment, the brake assembly 70 modulates the speed of hoisting during the reaming operation by applying a braking torque that resists the hoisting torque of the drawworks 50 so as to maintain the limits set by the operator for POB, ROH and/or the drilling torque.

FIG. 1 shows a schematic representation of the control system 110 of the current invention interconnected to a conventional drilling rig. In the depicted embodiment, a derrick 10 supports, at an upper end thereof, a crown block 15. A rope arrangement 17 connects the crown block 15 to a traveling block 20, or load bearing part, for supporting a hook structure 25. The hook structure 25 is connected to and supports a top drive assembly 12, which in turn is connected to a drill string 13. The drill string 13 includes one or more drill pipes and a drill bit 14 that produces a borehole 16 in a drilling operation upon rotation by the top drive assembly 12. The drawworks 50 is then used to hoist the drill string 13 out of the borehole 16 during a reaming operation.

The drawworks 50 is attached to a hoisting line 30, that assists the drawworks 50 in hoisting the drill string 13 during the reaming operation. The hoisting line 30 is securely fixed at one end to the ground by means of a dead line 35 and a dead line anchor 40. The other end of the hoisting line 30 forms a fast line 45 that is attached to the drawworks 50.

In the embodiment shown in FIG. 1, the drawworks 50 includes one or more motor(s) 55, such as an electrical, diesel or other appropriate motor, and a transmission 60 connected to a cylindrical rotatable drum 65 for wrapping and unwrapping the fast line 45 as required for operation of the associated crown block 15 and traveling block 20 during drilling and reaming operations. In such an embodiment, the rotatable drum 65 is also referred to as a winding drum or a hoisting drum. Although one embodiment of a hoist system is shown in FIG. 1 it should be understood that other hoist systems capable of controllably raising a drill pipe could be utilized with the automated reaming control system of the current invention.

As shown in FIG. 1, a plurality of positioning sensors, such as proximity switches 102 in the derrick 10 or an encoder 100 that is affixed to the drawworks drive shaft 85, may be used to determine the position of the traveling block 20 for additional safety and control during the reaming process. In such an embodiment, an output control signal 107 or 105, indicting the position of the traveling block 20 is sent from the proximity switches 102 or the encoder 100, respectively, to the control system 110. The actual speed and position of the traveling block 20 may then be used to ensure safe operation of the hoist during reaming. Although in one embodiment the positioning sensors are proximity switches 102, it should be understood that other means for determining the position of the traveling block 20 could be utilized with the automated reaming control system of the current invention.

Although any brake capable of automated control may be utilized in the current invention, as shown in FIG. 1, the brake assembly 70 preferably includes a primary friction brake 80, typically a band type brake or a caliper disk brake, an auxiliary brake 75, such as an eddy current type brake or a friction plate brake, and an emergency brake 78. The brake assembly 70 is connected to the drawworks 50 by a drive shaft 85 of the drawworks 50. The brake assembly 70 is controlled by the control system 110. Again, although any suitable actuator may be utilized in the current invention, typically the brake 70 of the current invention is actuated either hydraulically or pneumatically, using, for example, a pneumatic cylinder that is applied by rig air pressure that is modulated by control signals 109 issued by the control system 110 by way of, for example, an electronically controlled air valve.

As discussed above, to provide reaming monitoring signals to the control system 110, a number of sensors may be utilized in the current invention. In the embodiment depicted in FIG. 1, a load sensing device 90, such as a strain gage or a hydraulic load cell is affixed to the dead line 35, and produces an output control signal 95 indicating the tension in the dead line 35 and consequently, the load carried by the traveling block 20 or POB. This POB measurement from the load sensing device 90 is provided sent from the strain gage 90 to the control system 110. Various tension measuring devices may be employed to indicate the tension conditions on the line 35. In one embodiment, as shown in FIG. 1, the actual hook load or POB is calculated using the load sensing device 90 input in conjunction with the number of lines strung and a calibration factor. Alternatively, a conventional load cell, hydraulic tension transducers or other load measuring device may be associated with the derrick 10 to provide the output control signal 95 representative of the load carried by the traveling block 20.

Alternatively, or in addition, the system may also be provided with a sensor for monitoring the rate of hoisting. In such an embodiment, as shown in FIG. 1, a measuring device, such as an encoder 100, for example, is affixed to the drawworks drive shaft 85. In such an embodiment, an output control signal 105, representative of the speed of rotation of the rotatable drum 65 as the drum 65 rotates to pull in or pay out the fast line 45 and as the traveling block 20 rises or descends, is sent from the encoder 100 to the control system 110. Using such an encoder, the frequency of the signal may be used to measure the velocity of the traveling block 20 movement, typically, by calculating the actual drum 65 speed and ultimately the traveling block 20 speed based on lines strung, the diameter of the drum 65, the number of line wraps and the line size. Alternatively, the velocity of the traveling block 20 movement may be calculated from the change in the vertical position of the traveling block 20. In such a system, the ROH can be calculated from the velocity of the traveling block 20. In addition, the proximity switches 102 may be utilized to confirm the measurements taken by the encoder 100.

Finally, as shown in FIG. 1, alternatively, or in addition, the drilling torque may be monitored. The drilling torque may be measured by sensing the torque on the top drive or rotary table, such as by a torque sensor 104 or as reported by a top drive motor drive 112 or a rotary table drive 113. In such an embodiment, an output control signal 108 indicating of the drilling torque is sent from the torque sensor 104 or from the drive 112 or 113 to the control system 110. Alternatively, the drilling torque can be obtained by measuring the standpipe pressure when a downhole drilling motor is used.

Referring to FIGS. 1–3, the control system 110 is in signal connection with the brake assembly 70 to provide brake control signals 109, and continuously receives output control signals 95, 105, and 108 from the load sensing device 90, the encoder 100, and the torque sensor 104, respectively, wherein each of the output control signals 95, 105, and 108 is an electrical, digital or other appropriate signal. The control system 110 is also in signal communication with an operator control unit 115 located on or near the derrick 10 such that the operator can provide appropriate maximum values for the specified reaming parameters to be monitored. Alternatively, a separate workstation (not shown), located, for example, in an equipment room on or near the derrick 10, can be connected to the control system 110 to provide an additional user interface and configuration signals.

In one embodiment, as depicted in FIG. 2, the operator control center 115 or man-machine interface preferably includes an industrial processor driven monitor 160 wherein the operator or driller can set and control the specified reaming parameters. For example, the operator can enter the maximum values to be reached during the reaming operation for any or all of the pull on the drill bit (POB), the rate of hoisting (ROH), and the drilling torque.

As shown in FIG. 2, the control system 110 includes a programmable controller (the drawworks PC 155), such as a programmable logic controller, a single board computer or an equivalent, to which are input the measured reaming values from the various sensors, and the respective operator defined maximum values from the operator control center 115. The programmable controller 155 then compares the values and outputs appropriate control signals to the braking system and the drawworks that and are interfaced between the drive system 120 using, for example, a serial communication connection 150 such as, for example, an optical linkage and/or hard-wired linkage.

In the embodiment shown, two or more remote programmable controllers (PC) input/output (I/O) units 145 are used to control the brake assembly 70 (including, as shown in FIG. 2 any or all of the disc brake 80, the parking brake 75, and the emergency brake 78) of the drawworks 50 and the drawworks processor 155, although any suitable interface may be used. A processor 160 is also connected to the control system 110 for providing input and output of the operator values, operating parameters and calculated values during the performance of various drilling rig operations.

Although not necessary, the control system 110 may also be connected to the motor(s) 55 of the drawworks through the drive system 120. The motor(s) 55 may be an alternating current (ac) motor or a direct current (dc) motor and the drive system 120 is an ac or a dc drive, respectively. The drive system 120 may further include, for example, a controller 125, such as a programmable controller (PC) and one or more motor drives 130 connected to an ac bus 135 for providing control of the motor.

As discussed above, and shown in FIG. 3, the control system 110 of the current invention may includes an auto back reaming (ABR) mode that the operator initiates by engaging a drawworks clutch, i.e. a high 2B or a low 2A clutch. Engaging the clutch 2A or 2B while the ABR is enabled (such as while auto-drilling) commands the control system 110 to activate the drive system 120 and the brake assembly 70.

During operation in the ABR mode, the control system 110 senses when the operator activates either the low or high clutch control, which in turn activates low and high clutch solenoids 7*g* or 7*e*, respectively. Signals from the activated clutch solenoids 7*g* or 7*e* and/or pressure sensors 7D on the low 2A or a high 2B are then communicated to the control system 110 CPU, which senses the operator's intent to back ream.

Once the drawworks clutch 2 is engaged, the control system 110 calculates the amount of torque needed to be supplied from the drawworks motor(s) 55, and utilizes an output signal 7F to control the torque command selector 9, which in turn outputs a torque input 120C to the drawworks drive 120. The drawworks motor(s) 55 in turn produces torque, which exceeds that required to hold the load of the traveling block 20 stationary. The starting torque is calculated as the static hookload plus the operator entered maximum POB value.

The control system 110 then utilizes control signals from the various sensors 7C to calculate and monitor the reaming parameters, and these values are compared versus the limits on those parameters input by the operator, to ensure that the back reaming operation is performed within the operator limits. If the measured values from the sensors match or exceed the limits input by the operator, the CPU sends a signal to the brake actuator, which in turn controls the braking system 70 to apply a torque to resist the hoisting torque of the drawworks motor(s) 55 and control the rate of hoisting of the drill string, to in turn maintain the limits input by the operator for ROH, POB, and/or the drilling torque. The CPU commands the braking system 70 to apply a torque that resists the hoisting torque of the drawworks motor(s) 55 such that the hoisting speed is reduced until the relevant maximum value is no longer exceeded, and then commands the brake actuator to reduce the resisting torque of the brake system 70 to allow the drawworks motor(s) 55 to increase the speed of hoisting.

For example, if while hoisting and back reaming, the top drive motor torque exceeds the limit input by the operator for drilling torque due to a tight hole condition, the CPU commands the brake actuator to control the brake assembly 70 to apply the brake to reduce the rate of hoisting to allow the drill motor torque to decrease as it drills through the tight area more slowly. This is possible because of the smooth proportional control of the brake assembly 70 and its sufficient capacity to produce more torque than the drawworks motor(s) 55 provides in this mode.

If stopping the drawworks motor(s) 55 completely is required to prevent the reaming system from exceeding one or more of the limits for the specified reaming parameters input by the operator, the control system 110 sends a torque command 7F to the torque command selector 9, which in turn sends a torque command 120C from the drive system 120 to reduce the torque produced by the drawworks motor(s) 55 to zero. This prevents damage to the motor and allows safe operation.

When the control system 110 is not in the ABR mode, the drawworks torque command will come from a manual hand or foot throttle, or an equivalent device.

In an alternative embodiment other controls may be used by the operator to command hoisting torque while the braking system is still used for speed control of the hoisting.

As described above, the control system continuously monitors specified back reaming parameters and compares the measured values to the limits or maximum values input by the operator for the specified back reaming parameters. When any of the maximum values are meet or exceeded, a control signal is sent to the drawworks to reduce the speed of the hoisting. However, although the above description has focused on the monitoring of specific back reaming parameters, measured by specific back reaming parameter sensors, the monitored back reaming parameters can be any one or any combination of: weight on bit, hoisting torque, hoisting speed, drilling mud flow, drilling mud pressure, and formation cutting condition of mud screens within the drilling mud. These back reaming parameters can be measured by back reaming parameter sensors including any one or any combination of: strain gauges, proximity sensors/switches, cameras, gyroscopes, encoders, and magnetic pick ups/switches.

The preceding description has been presented with references to presently preferred embodiments of the invention. Persons skilled in the art and technology to which this invention pertains will appreciate that alterations and changes in the described structures and methods of operation can be practiced without meaningfully departing from the principle, spirit and scope of this invention, such as various changes in the size, shape, materials, components, circuit elements, wiring connections, as well as other details of the illustrated circuitry and construction. Accordingly, the foregoing description should not be read as pertaining only to the precise structures described and shown in the accompanying drawings, but rather should be read as consistent with and as support for the following claims, which are to have their fullest and fairest scope.

What is claimed is:

1. An automated method for controlling a back reaming operation of a drilling rig, the method comprising:

providing a hoisting system that moves a drill pipe during a back reaming operation at a hoisting speed and a hoisting torque, wherein the hoisting system comprises at least one back reaming parameter sensor for measuring a corresponding at least one back reaming parameter;

comparing a predetermined value of the at least one back reaming parameter with the measured value for the at least one back reaming parameter; and initiating a braking assembly that resists the hoisting torque of the hoisting system when the measured value of the at least one back reaming parameter equals the predetermined value of the at least one back reaming parameter.

2. The method of claim 1, further comprising providing a control system, wherein the control system compares the predetermined value of the at least one back reaming parameter with the measured value for the at least one back reaming parameter.

3. The method of claim 2, wherein the control system initiates the braking assembly when the measured value of the at least one back reaming parameter equals the predetermined value of the at least one back reaming parameter.

4. The method of claim 1, further comprising providing an operator control unit that allows an operator to input the predetermined value of the at least one back reaming parameter therein.

5. The method of claim 1, wherein providing a hoisting system comprises providing a drawworks system.

6. The method of claim 1, wherein the at least one back reaming parameter comprises at least one back reaming parameter chosen from the group consisting of rate of hoisting of the drill pipe, pull on a drill bit of the drill pipe, drilling torque applied to the drill pipe, drilling mud flow, drilling mud pressure, and formation cutting condition of mud screens within the drilling mud.

7. An automated method for controlling a back reaming operation of a drilling rig, the method comprising:

providing a drawworks system that moves a drill pipe during a back reaming operation at a hoisting speed and a hoisting torque, wherein the hoisting system comprises at least one back reaming parameter sensor for measuring a corresponding at least one back reaming parameter;

providing an operator control unit that allows an operator to input a predetermined value of the at least one back reaming parameter therein;

providing a control system that compares the predetermined value of the at least one back reaming parameter with the measured value for the at least one back reaming parameter, wherein the control system initiates a braking assembly that resists the hoisting torque of the drawworks system when the measured value of the at least one back reaming parameter equals the predetermined value of the at least one back reaming parameter.

8. The method of claim 7, wherein the at least one back reaming parameter comprises at least one back reaming parameter chosen from the group consisting of rate of hoisting of the drill pipe, pull on a drill bit of the drill pipe, drilling torque applied to the drill pipe, drilling mud flow, drilling mud pressure, and formation cutting condition of mud screens within the drilling mud.

9. A system that controls a back reaming operation of a drilling rig, the system comprising:

a hoisting system that moves a drill pipe during a back reaming operation at a hoisting speed and a hoisting torque, wherein the hoisting system comprises at least one back reaming parameter sensor for measuring a corresponding at least one back reaming parameter;

an operator control unit that allows an operator to input a predetermined value of the at least one back reaming parameter therein;

a back reaming parameter sensor that obtains the measured value of the at least one back reaming parameter;

a control system that monitors the at least one back reaming parameter; and a braking assembly that resists the hoisting torque of the drawworks system when the measured value of the at least one back reaming parameter equals the predetermined value of the at least one back reaming parameter.

10. The system of claim 9, wherein the control system monitors the at least one back reaming parameter by comparing the predetermined value of the at least one back reaming parameter with the measured value of the at least one back reaming parameter.

11. The system of claim 10, wherein the control system initiates the braking assembly when the measured value of the at least one back reaming parameter equals the predetermined value of the at least one back reaming parameter.

12. The system of claim 9, wherein the hoisting system comprises a drawworks system.

13. The system of claim 9, wherein the at least one back reaming parameter comprises at least one back reaming parameter chosen from the group consisting of rate of hoisting of the drill pipe, pull on a drill bit of the drill pipe, drilling torque applied to the drill pipe, drilling mud flow, drilling mud pressure, and formation cutting condition of mud screens within the drilling mud.

* * * * *